United States Patent [19]

Wise

[11] Patent Number: 4,866,915

[45] Date of Patent: Sep. 19, 1989

[54] ENVELOPE CONTENTS REMOVAL

[76] Inventor: John D. Wise, 99 East 33rd St., Paterson, N.J. 07514

[21] Appl. No.: 283,084

[22] Filed: Dec. 12, 1988

[51] Int. Cl.[4] ..... B65B 69/00

[52] U.S. Cl. ..... 53/492; 53/381 R; 83/912

[58] Field of Search ..... 53/492, 390, 382, 381 R, 53/206, 266 A; 83/912

[56] References Cited

U.S. PATENT DOCUMENTS

| | | | |
|---|---|---|---|
| 4,123,890 | 11/1978 | Russell et al. | 53/492 X |
| 4,142,430 | 3/1979 | Long et al. | 83/912 X |
| 4,272,943 | 6/1981 | Russell | 53/492 |

*Primary Examiner*—James F. Coan

*Attorney, Agent, or Firm*—Samuelson & Jacob

[57] ABSTRACT

Apparatus and method for assisting in the removal of contents from an envelope by cutting an opening in the envelope along a first peripheral edge thereof, gripping the envelope along a second peripheral edge thereof opposite the first peripheral edge, penetrating the envelope with a picker to engage the contents, and moving the picker and the contents engaged by the picker in the direction transverse to the opening while the envelope is gripped and maintained stationary, the envelope being slit as a result of the lateral movement of the picker to permit the lateral movement of the picker and the corresponding movement of the contents engaged by the picker so as to move the contents partially out of the envelope, through the opening therein.

12 Claims, 3 Drawing Sheets

ENVELOPE CONTENTS REMOVAL

The present invention relates generally to the opening of envelopes and the removal of materials carried in the envelopes and pertains, more specifically, to apparatus and method for assisting in the removal of sheet-like contents from envelopes.

The handling of letters and other documents packaged in envelopes has become more and more mechanized as the volume of enveloped materials has increased. Many devices are available for the opening of envelopes and the removal of the enveloped contents on a high-volume, automated basis.

The present invention provides apparatus and method by which the removal of sheet-like contents from an envelope is assisted in a positive manner, utilizing simplified apparatus and method, and exhibits several objects and advantages, some of which may be summarized as follows: Enables the positive displacement of the contents of an envelope out of the envelope for assisting in the removal of the contents on a high-volume, high-speed basis; Makes available simplified apparatus and method for assisting in the processing of enveloped materials in a continuous, high-speed manner so that practical high-speed processing becomes available to a wider audience; Provides reliable operation for increased productivity with less downtime; Enables mechanized, high-speed, high-volume processing of enveloped materials with relatively inexpensive apparatus and without the necessity for prior sorting to separate envelopes of various sizes; Provides apparatus and method adaptable for use with a wide variety of enveloped materials, with reliability and economy, over a relatively long service life.

The above objects and advantages, as well as further objects and advantages, are attained by the present invention, which may be described briefly as apparatus and method for assisting in the removal of contents, such as a sheet, from an envelope, the envelope having opposite panels, at least one of which panels has a given thickness, peripheral edges along the perimeter of the envelope, and an interior behind the panels, within which interior the contents are enveloped, the envelope including an opening extending in a longitudinal direction essentially along at least one of the peripheral edges of the envelope, the apparatus and method comprising means for and the steps of: gripping a portion of the envelope adjacent a peripheral edge of the envelope other than the one peripheral edge along which the opening extends; penetrating through the given thickness of the one of the opposite panels to engage the contents for movement of the contents; and moving the engaged contents relative to the envelope along a prescribed path of travel, the prescribed path of travel including a segment transverse to the longitudinal direction of the opening, while slitting the penetrated panel as the contents are moved along the transverse segment of the path of travel, such that the contents are moved relative to the penetrated panel in the transverse direction and through the opening in the envelope for assisting removal from the envelope.

The invention will be understood more fully, while still further objects and advantages will become apparent, in the following detailed description of preferred embodiments of the invention illustrated in the accompanying drawing, in which.

Figure 1:
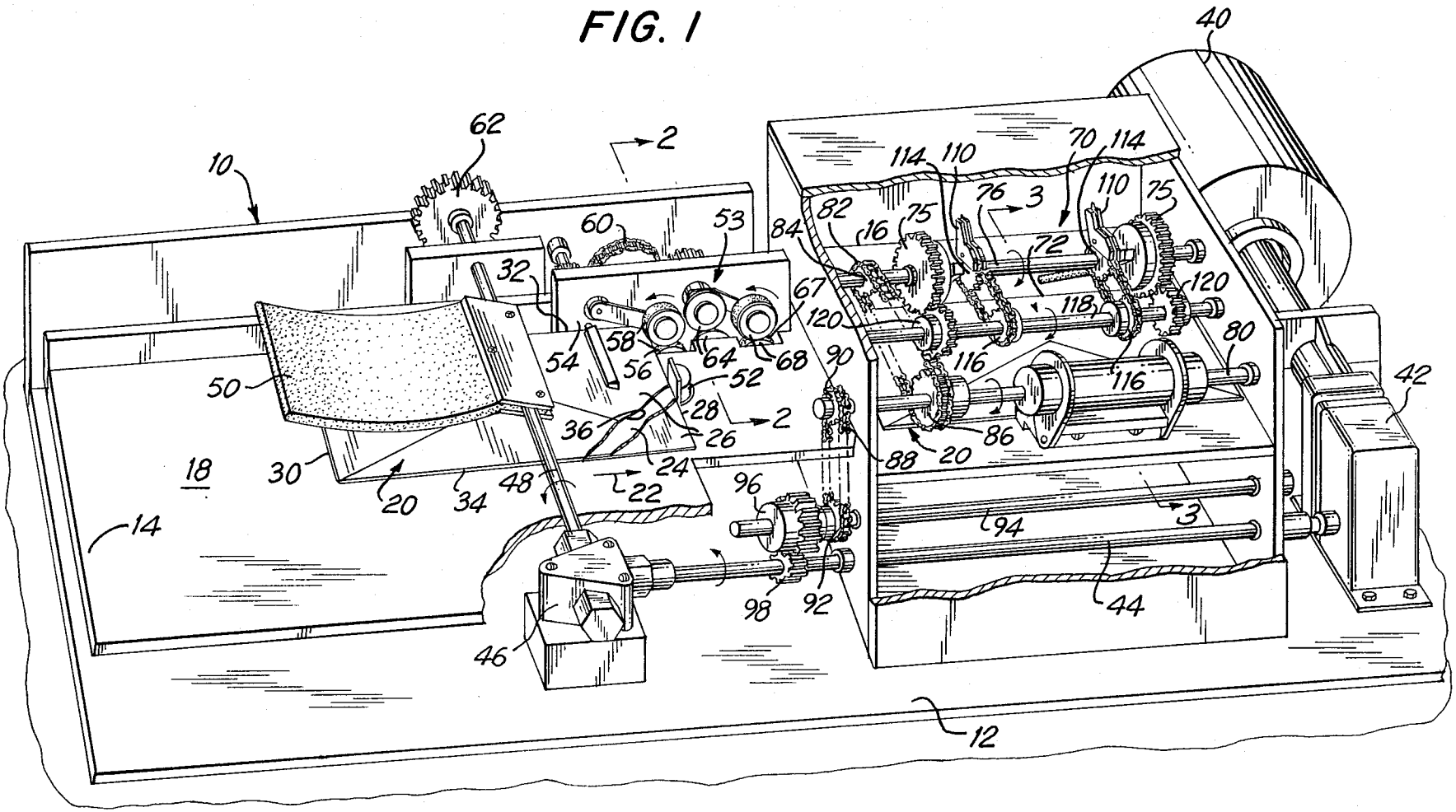
FIG. 1 is a perspective view of apparatus constructed in accordance with the invention, with portions broken away for illustrative purposes.

Referring now to the drawing, and especially to FIG. 1 thereof, an apparatus constructed in accordance with the invention is illustrated generally at 10 and is seen to include a frame 12 extending longitudinally from an inlet end 14 toward an outlet 16. A platform 18 receives incoming envelopes, one of which is illustrated at 20, for processing, the envelopes 20 being advanced serially along the platform 18 in the downstream direction indicated by the arrow 22. Envelopes 20 are in the form of letter mail, each envelope 20 being sealed and containing sheet-like contents 24 packaged within the envelope 20, between opposite panels 26 of the envelope 20, which panels 26 extend longitudinally and laterally between peripheral edges located along the periphery of the envelope, the peripheral edges including a leading edge 28, a trailing edge 30 and opposite side edges 32 and 34. Apparatus 10 assists in the removal of the contents 24 from the interior 36 of the envelope 20.

Figure 2:
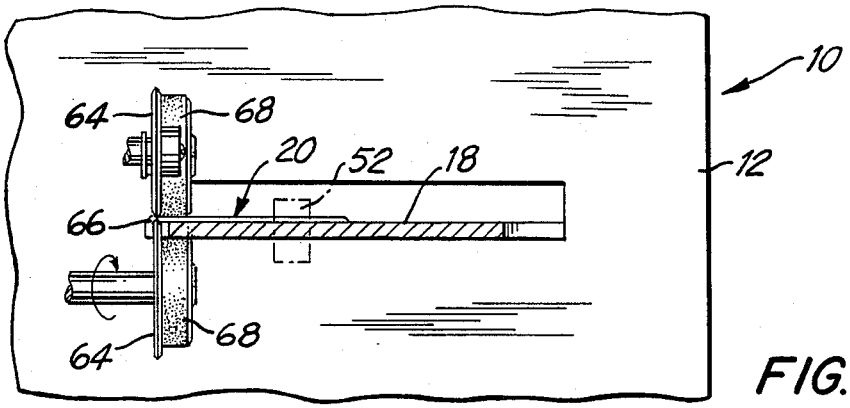
FIG. 2 is a transverse cross-sectional view taken along line 2—2 of FIG. 1.

Apparatus 10 includes a drive motor 40 coupled to a gear drive 42 which, in turn, drives a main drive shaft 44 journaled on frame 12. A right-angle drive 46 is coupled to main drive shaft 44 and drives envelope feed shaft 48 which carries a feeder in the form of a flap 50 of resilient material, such as a pad of resilient foamed synthetic resin. Flap 50 is rotated in the direction indicated and engages each envelope 20 to sweep the envelope in the direction of arrow 22. A stop 52 is placed in the path of travel of the envelope 20 and engages the leading edge 28 of the envelope 20 to locate and restrain the envelope 20 from movement downstream until the start of a cycle of operation which will open the envelope and assist in the removal of the contents 24. The cycle of operation is as follows: In response to the rotation of envelope feed shaft 48, a cam and lever arrangement(not shown) located beneath the platform 18 retracts the stop 52 and permits the flap 50 to sweep the envelope forward, in the downstream direction, through an envelope opening station 53. The envelope 20 is guided by the abutment of the edge 32 against a guide surface 54 so that the envelope 20 enters the nip 56 of a pair of feed rollers 58. Feed rollers 58 are driven by a gear train 60 engaged with a drive gear 62 on the envelope feed shaft 48 and move the envelope forward, in the downstream direction, so that the portion of the envelope 20 immediately adjacent the peripheral side edge 32 passes between a pair of slicing wheels 64, as seen in FIG. 2. The slicing wheels 64 also are driven by the gear train 60 and serve as cutting means for cutting the envelope 20 to slice a very narrow edge portion 66 from the remainder of the envelope 20 as the envelope 20 passes between the slicing wheels 64. The envelope 20 proceeds from the slicing wheels 64 into the nip 67 of a second pair of feed rollers 68, also driven by the gear train 60, so that the envelope will continue downstream, after the edge portion 66 is removed, to be presented to a contents displacement station 70, with an opening 72 established along the envelope 20 adjacent the peripheral side edge 32 of the envelope 20 as a result of the removal of the edge portion 66.

Figure 3:
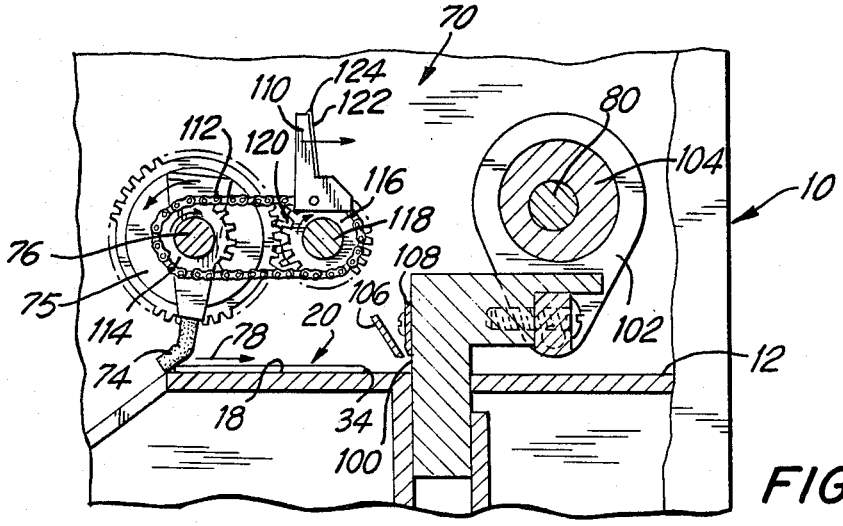
FIGS. 3 through 7 are a series of transverse cross-sectional views taken along line 3—3 of FIG. 1 and are somewhat diagrammatic so as to illustrate the operation of the apparatus and the method of the invention.
Figure 4:
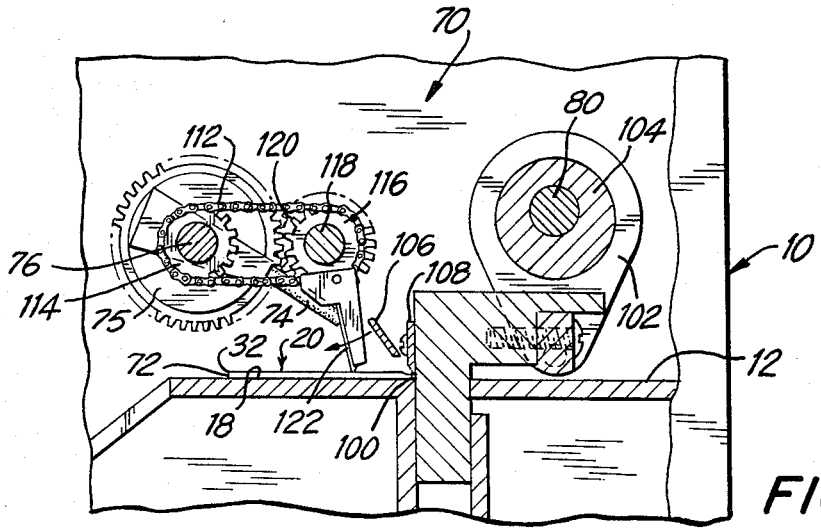

Turning now to FIGS. 3 and 4, as well as to FIG. 1, once the envelope 20 is in the contents displacement station 70, the envelope 20 is griped and the contents 24 are moved partially out of the envelope 20, through the opening 72. Thus, as seen in FIG. 3, a pair of resilient fingers 74 are mounted for rotation with a corresponding pair of gears 75 journaled for rotation on a first sub-shaft 76, independent of the rotation of sub-shaft 76, and rotated in the manner described below so that the fingers 74 sweep transversely over the portion of the platform 18 which lies in the contents displacement station 70 and engage the envelope 20 at the station 70 to move the envelope laterally, as indicated by the arrow 78. First sub-shaft 76 is coupled for rotation with a second sub-shaft 80 by means of a drive chain 82 and sprockets 84 and 86, and the second sub-shaft 80 is driven by another drive chain 88 and corresponding sprockets 90 and 92, sprocket 92 being mounted for rotation with still another sub-shaft 94 which, in turn, is rotated by a gear 96 driven by a meshing gear 98 affixed to main drive shaft 44. The fingers 74 preferably are constructed of a resilient material, such as an elastomer or a flexible foamed synthetic resin, and frictionally engage the envelope 20 to serve as biasing means urging the envelope against a stop fence 100. Stop fence 100 is carried by a pair of links 102 suspended from an eccentric 104 mounted for rotation with second sub-shaft 80. A guide 106 assures that the peripheral side edge 34 of the envelope 20 remains against the platform 18 and, as the second sub-shaft 80 rotates, the eccentric 104 moves the stop fence 100 downwardly so that gripping means in the form of a clamp bar 108 which is carried by the stop fence 100 grips the envelope adjacent the peripheral side edge 34 and holds the envelope 20 in place within the contents displacement station 70.

Figure 5:
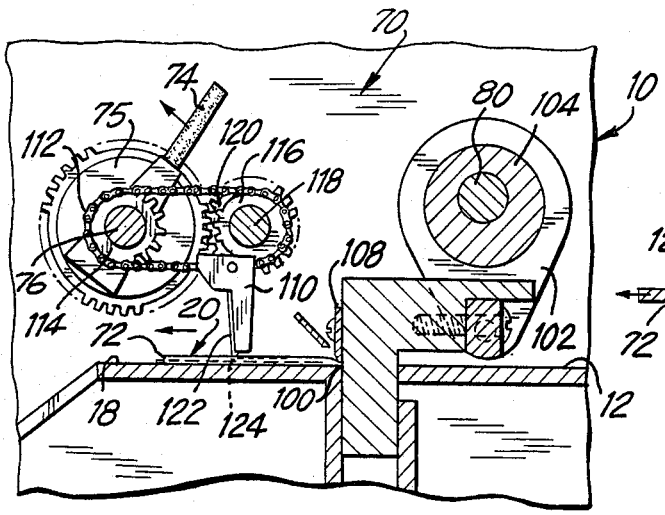
Figure 5A:
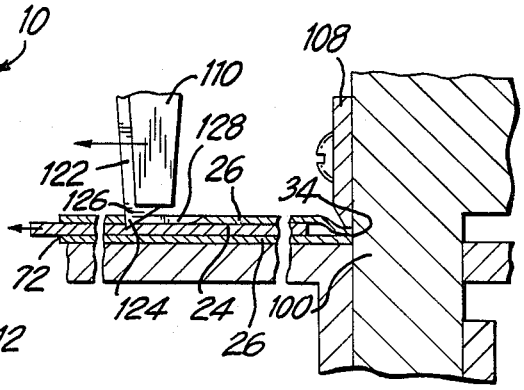
Figure 6:
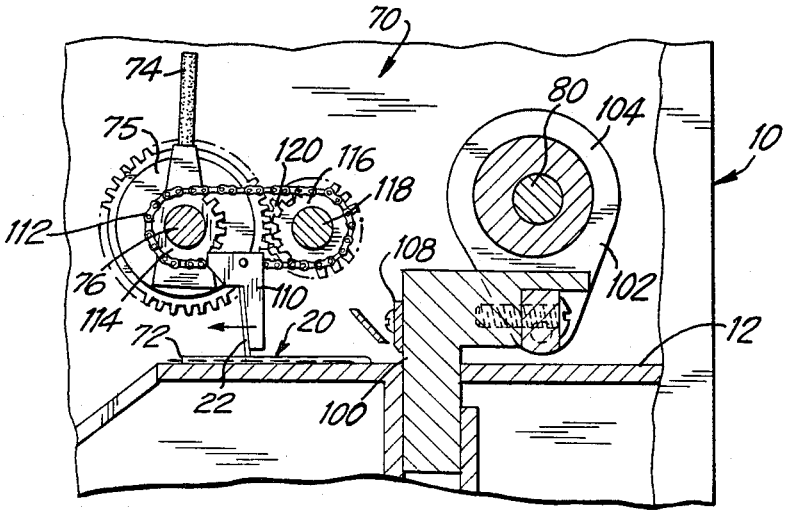
Figure 7:
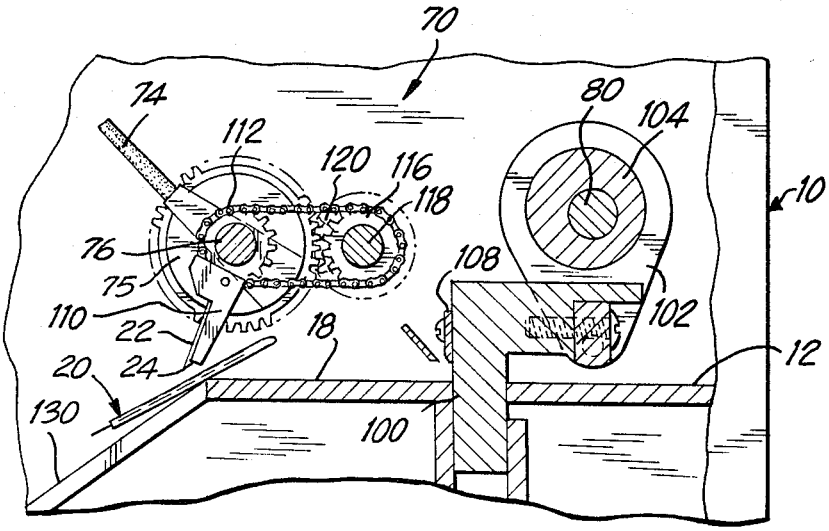

Referring now to FIGS. 3 through 7, as well as to FIG. 1, picker means include a pair of picker arms 110 carried upon respective carrier chains 112 engaged with corresponding sprockets 114 and 116. Sprockets 114 are affixed for rotation with first sub-shaft 76 and sprockets 116 are affixed to yet another sub-shaft 118 so that the sprockets 114 and 116 rotate with the sub-shafts 76 and 118 and picker arms 110 move in the direction indicted by arrows in FIGS. 3 through 7, transverse to the longitudinal extent of the envelope 20 and the direction of the opening 72 in the envelope. At the same time, gears 120 affixed to sub-shaft 118 rotate the pair of gears 75 which carry the fingers 74. Each picker arm 110 carries a blade 122 which includes a pointed picker 124 at the remote end of the blade 122. As the picker arms 110 reach the envelope 20, as seen in FIG. 4, the pickers 124 begin to penetrate the upper panel 26 of the envelope 20. Continued movement of the picker arms 110 along the prescribed path of travel of the picker arms 110, as illustrated in FIG. 5, causes the pickers 124 to penetrate through the upper panel 26 to engage the contents 24, as best seen in FIG. 5A. Upper panel 26 has a given thickness and the pickers 124 have a length which enables the pickers 124 to extend through the upper panel 26 and engage contents 24 with a purchase sufficient to move the contents 24 with movement of the pickers 124. Blades 122 each include a slitter portion 126 adjacent the picker 124. With the envelope 20 gripped adjacent the peripheral side edge 34, further movement of the picker arms 110 along the segment of the prescribed path of travel thereof illustrated in FIGS. 5 and 6 will cause the slitter portions 126 to slit the upper panel 26 of the envelope, as seen at 128 in FIG. 5A, while the engaged contents 24 are displaced laterally with the lateral movement of the pickers 124 to move the contents 24 through the opening 72 at the opposite side of the envelope 20. It is noted that the clamp bar 108 grips the envelope 20 over a very limited area closely adjacent the peripheral side edge 34 so that the contents 24 are not gripped and are free to move relative to the envelope 20 within which the contents 24 are enveloped. When the contents 24 are so displaced, the clamp bar 108 is raised, as seen in FIG. 6, and the envelope 20 is free to move with the pickers 124. Such movement of the envelope 20 delivers the envelope to a chute 130 where the envelope 20, with the contents 24 exposed through the opening 72, is discharged from the apparatus 10. The envelopes 20, with the exposed contents 24, are then ready for manual handling to complete the removal of the contents 24 from each envelope 20. The exposure of the contents 24 through the opening 72 facilitates completion of the manual removal of the contents from the envelope. Since the contents 24 are not completely removed from the respective envelopes 20 as the envelopes emerge from the apparatus 10, the envelopes 20 and the contents 24 still may be matched after the envelopes 20 emerge from the apparatus 10, thus providing a feature which is important in most mail room procedures.

It will be seen that the apparatus 10, and the method illustrated above, enable the simplified handling of enveloped material with economy and ease. The apparatus and method are capable of accommodating envelopes of all sizes, without the necessity for sorting beforehand.

It is to be understood that the above detailed description of preferred embodiments of the invention are provided by way of ex ample only. Various details of design, construction and procedure may be modified without departing from the true spirit and scope of the invention as set forth in the appended claims.

The embodiments of the invention in which an exclusive property or privilege is claimed are defined as follows:

1. Apparatus for assisting in the removal of contents, such as a sheet, from an envelope, the envelope having opposite panels, at least one of which panels has a given thickness, peripheral edges along the perimeter of the envelope, and an interior behind the panels, within which interior the contents are enveloped, the envelope including an opening extending in a longitudinal direction essentially along at least one of the peripheral edges of the envelope, the apparatus comprising:

gripping means for gripping a portion of the envelope adjacent a peripheral edge of the envelope other than the one peripheral edge along which the opening extends;

picker means including a picker for penetrating through the given thickness of the one of the opposite panels to engage the contents for movement of the engaged contents with the picker; and drive means for moving the picker along a prescribed path of travel, the prescribed path of travel including a segment transverse to the longitudinal direction of the opening;

the picker means including a slitter adjacent the picker for slitting the penetrated panel as the picker is moved along th transverse segment of the path of travel, with the contents engaged by the picker, such that the contents are moved by the picker, relative to the penetrated panel, in the transverse direction and through the opening in the envelope for assisting removal from the envelope.

2. The invention of claim 1 including cutting means for cutting the opening along the one of the peripheral edges of the envelope.

3. The invention of claim 2 including feed means for feeding the envelope along a path of travel from the cutting means to the gripping means.

4. The invention of claim 3 wherein the gripped portion of the envelope is located along the peripheral edge laterally opposite the one of the peripheral edges along which the opening extends and the gripping means includes a longitudinally extending fence, lateral biasing means for urging the envelope laterally against the fence and clamping means adjacent the fence for clamping the gripped portion of the envelope adjacent the fence.

5. The invention of claim 4 wherein the lateral biasing means includes fingers engageable with the envelope, and further drive means for driving the fingers in a lateral direction, when the fingers are engaged with the envelope, to urge the envelope against the fence.

6. The invention of claim 1 wherein the gripped portion of the envelope is located along the peripheral edge laterally opposite the one of the peripheral edges along which the opening extends and the gripping means includes a longitudinally extending fence, lateral biasing means for urging the envelope laterally against the fence and clamping means adjacent the fence for clamping the gripped portion of the envelope adjacent the fence.

7. The invention of claim 6 wherein the lateral biasing means includes fingers engageable with the envelope, and further drive means for driving the fingers in a lateral direction, when the fingers are engaged with the envelope, to urge the envelope against the fence.

8. The method for assisting in the removal of contents, such as a sheet, from an envelope, the envelope having opposite panels, at least one of which panels has a given thickness, peripheral edges along the perimeter of the envelope, and an interior behind the panels, within which interior the contents are enveloped, the envelope including an opening extending in a longitudinal direction essentially along at least one of the peripheral edges of the envelope, the method comprising the steps of:

gripping a portion of the envelope adjacent a peripheral edge of the envelope other than the one peripheral edge along which the opening extends;

penetrating through the given thickness of the one of the opposite panels to engage the contents for movement of the engaged contents; and moving the contents relative to the envelope along a prescribed path of travel, the prescribed path of travel including a segment transverse to the longitudinal direction of the opening, while slitting the penetrated panel as the contents are moved along the transverse segment of the path of travel, such that the contents are moved relative to the penetrated panel in the transverse direction and through the opening in the envelope for assisting removal from the envelope.

9. The invention of claim 8 including cutting the opening along the one of the peripheral edges of the envelope.

10. The invention of claim 9 including feeding the envelope along a path of travel between the cutting step and the gripping step.

11. The invention of claim 10 wherein the gripped portion of the envelope is located along the peripheral edge laterally opposite the one of the peripheral edges along which the opening extends and the method includes urging the envelope laterally prior to gripping the portion of the envelope adjacent the peripheral edge of the envelope other than the one peripheral edge along which the opening extends.

12. The invention of claim 8 wherein the gripped portion of the envelope is located along the peripheral edge laterally opposite the one of the peripheral edges along which the opening extends and the method includes urging the envelope laterally prior to gripping the portion of the envelope adjacent the peripheral edge of the envelope other than the one peripheral edge along which the opening extends.

* * * * *